US011918129B1

(12) United States Patent
Li et al.

(10) Patent No.: US 11,918,129 B1
(45) Date of Patent: Mar. 5, 2024

(54) LIFTING STRUCTURE OF DISPLAY RACK

(71) Applicant: JIREE (HUA'AN) TECHNOLOGY CO., LTD., Zhangzhou (CN)

(72) Inventors: Xiaodong Li, Zhangzhou (CN); Shuangbing Li, Zhangzhou (CN); Xian Chen, Zhangzhou (CN); Dadong Su, Zhangzhou (CN)

( * ) Notice: Subject to any disclaimer, the term of this patent is extended or adjusted under 35 U.S.C. 154(b) by 0 days.

(21) Appl. No.: 18/098,698

(22) Filed: Jan. 19, 2023

(30) Foreign Application Priority Data

Nov. 17, 2022 (CN) ..... 202223058843.6

(51) Int. Cl.
*A47F 5/00* (2006.01)
*A47B 47/00* (2006.01)
*A47B 51/00* (2006.01)

(52) U.S. Cl.
CPC ..... *A47F 5/0081* (2013.01); *A47B 47/0083* (2013.01); *A47B 51/00* (2013.01)

(58) Field of Classification Search
CPC ..... A47F 5/0081; A47F 1/06; A47F 1/126; A47F 3/08; A47B 47/0083; A47B 51/00; B65G 1/07; B65G 1/026
USPC ..... 211/59.3, 51, 1.57; 312/61, 71
See application file for complete search history.

(56) References Cited

U.S. PATENT DOCUMENTS 2,319,872 A * 5/1943 Leonard ..... B65D 7/06 211/59.3
2,444,776 A * 7/1948 Kalning ..... B65G 1/07 211/59.3
2,614,012 A * 10/1952 Yuan ..... A47B 9/00 108/147.2
2,717,085 A * 9/1955 Waddington ..... B65G 1/07 211/74
2,802,575 A * 8/1957 Jeune ..... B65G 1/07 108/106
2,816,808 A * 12/1957 Haines ..... B65G 1/07 211/59.3
2,928,639 A * 3/1960 Shelley ..... A47B 51/00 211/59.3
2,934,211 A * 4/1960 Shivek ..... B65G 1/07 254/374
3,123,829 A * 3/1964 Bronson ..... A47B 81/04 211/59.3
3,163,292 A * 12/1964 Shelley ..... A47B 51/00 211/59.3
3,168,198 A * 2/1965 Shelley ..... A47B 91/02 211/59.3
3,361,510 A * 1/1968 McDermott ..... A47B 51/00 248/404
3,388,677 A * 6/1968 Mackay ..... A47F 1/06 211/59.3

(Continued)

*Primary Examiner* — Jennifer E. Novosad

(57) ABSTRACT

A lifting structure of a display rack includes an upright post, a retainer, a lifting support, and a tension spring. The upright post includes a guide rail on an inner corner of the upright post. The retainer is installed on an upper end of the guide rail. The lifting support includes a support portion that is movably fitted in the inner corner of the upright post and a slide portion that is slidably fitted in the guide rail. The support portion is configured to support a bearing plate of the display rack. Upper and lower ends of the tension spring are connected to the retainer and the slide portion, respectively. The lifting structure of the display rack can be lifted and lowered smoothly without shaking.

8 Claims, 9 Drawing Sheets

(56) References Cited

U.S. PATENT DOCUMENTS 3,407,015 A * 10/1968 Silberberg ..... B65G 1/07 312/71
3,475,069 A * 10/1969 Olsen ..... B65G 1/07 211/59.3
3,494,503 A * 2/1970 Kingsley ..... B65G 1/07 312/306
3,511,548 A * 5/1970 McIlhone ..... B65G 1/07 108/136
3,568,804 A * 3/1971 Olsen ..... B66F 7/025 187/244
3,635,173 A * 1/1972 Ruben ..... B65G 1/07 108/136
3,738,722 A * 6/1973 Kooiman ..... B65G 1/07 211/59.3
3,739,879 A * 6/1973 House ..... B23Q 11/0014 108/136
3,993,373 A * 11/1976 Vershbow ..... B65G 1/07 312/71
4,009,915 A * 3/1977 Whitelaw ..... B65G 1/07 312/71
4,329,928 A * 5/1982 Shaw ..... A47B 51/00 108/106
4,592,485 A * 6/1986 Anderson ..... H05B 6/808 99/359
4,828,119 A * 5/1989 Pingelton ..... B65G 1/07 211/59.3
5,013,983 A * 5/1991 Futch ..... B65G 1/07 211/59.3
5,119,946 A * 6/1992 Baker ..... B65G 1/07 211/59.3
5,167,302 A * 12/1992 Kinoshita ..... B62B 3/02 187/244
5,181,620 A * 1/1993 Watt ..... A47F 5/0081 211/59.3
5,199,600 A * 4/1993 Fietsam ..... B65G 1/07 221/244
5,211,296 A * 5/1993 D'Heygere ..... B65G 1/0421 211/175
5,322,171 A * 6/1994 Pingelton ..... B65G 1/07 211/59.3
5,421,481 A * 6/1995 Fortmann ..... B65G 1/07 312/319.1
6,450,360 B1 * 9/2002 Hyde ..... B65G 1/07 211/59.3
6,899,347 B2 * 5/2005 Neal ..... B62B 3/002 187/244
7,481,440 B2 * 1/2009 Weber ..... B62B 1/10 414/495
7,611,111 B2 * 11/2009 Costa ..... A47F 5/0081 211/103
9,738,299 B2 * 8/2017 Ard ..... B62B 3/02
2002/0046981 A1 * 4/2002 Amish ..... B65G 1/07 211/49.1
2012/0248046 A1 * 10/2012 Warner ..... A47B 51/00 211/1.57
2014/0311995 A1 * 10/2014 Reimer ..... B65G 1/10 211/49.1
2023/0249908 A1 * 8/2023 Steinberg ..... B65G 1/026 211/209

* cited by examiner

LIFTING STRUCTURE OF DISPLAY RACK

BACKGROUND OF THE INVENTION

1. Field of the Invention

The present invention relates to a display rack, and more particularly to a lifting structure of a display rack.

2. Description of the Prior Art

In general, a conventional display rack is equipped with an automatic lifting structure to move the bearing plate of the display rack up and down automatically. After the articles are taken away, the remaining articles ascend to the required height automatically for the next customer to pick up the articles. There is no need for the customer to stoop to pick up the articles.

As shown in FIG. 1, a large spring c is arranged between the bottom of a frame a and a bearing plate b of the conventional display rack. The bearing plate b is moved up and down automatically via the elastic force of the spring c. However, the conventional display rack has the following problems in use.

1. The stiffness coefficient of the large spring c is relatively large. When some low-density, light-weight articles (such as paper towels, dolls, bread, etc.) are displayed on the bearing plate b, even after the articles are stacked to a certain volume, the overall weight of the articles is not enough to exert sufficient force on the spring c. As a result, the automatic lifting function of the display rack fails.

2. The single large spring c mainly acts on the center of the lower surface of the bearing plate b. When the articles on the bearing plate b are placed unevenly, the bearing plate b is prone to tilt, resulting in instability in the lifting process. The bearing plate cannot be moved up and down smoothly.

SUMMARY OF THE INVENTION

The primary object of the present invention is to provide a lifting structure of a display rack, which can be lifted and lowered smoothly without shaking. The display rack is especially suitable for displaying articles of light weight.

In order to achieve the above object, the present invention adopts the following technical solutions:

A lifting structure of a display rack comprises an upright post, a retainer, a lifting support, and a tension spring. The upright post includes a guide rail on an inner corner of the upright post. The retainer is installed on an upper end of the guide rail. The lifting support includes a support portion that is movably fitted in the inner corner of the upright post and a slide portion that is slidably fitted in the guide rail. The support portion is configured to support a bearing plate of the display rack. Upper and lower ends of the tension spring are connected to the retainer and the slide portion, respectively.

First rollers are installed on the slide portion. The first rollers are configured to roll on side walls of the guide rail. The number of the first rollers is two. Axes of the two first rollers are perpendicular to each other.

The inner corner of the upright post includes two vertical faces perpendicular to each other. The guide rail is disposed at a joint between the vertical faces. A gap is defined between the inner corner and the guide rail.

Preferably, second rollers are installed on the support portion. The second rollers are configured to roll on the vertical faces. The number of the second rollers is two. Axes of the two second rollers are perpendicular to each other.

Preferably, two pairs of upper and lower second rollers are disposed on the support portion.

Preferably, a connecting plate is connected between the support portion and the slide portion. The connecting plate is in clearance fit with the gap. The connecting plate has a mounting hole for connection of the tension spring.

The retainer is insertedly connected to an upper end of the upright post.

The lifting support includes four lifting supports. A support pipe is connected between every adjacent two of the lifting supports.

Preferably, a connector is provided between the lifting support and either end of the support pipe. One side of the lifting support has a vertical engaging groove and a restricting plate under the engaging groove. One end of the connector has an engaging block. The engaging block is inserted downward and engaged in the engaging groove to be positioned on the restricting plate. The support pipe is sleeved on another end of the connector.

By adopting the above technical solutions, the present invention has the following technical effects:

1. The guide rail is disposed on the inner corner of the upright post. The slide portion of the lifting support is slidably connected to the guide rail. The retainer is disposed on the upper end of the guide rail. The upper and lower ends of the tension spring are connected to the retainer and the slide portion, respectively. When articles are placed on the bearing plate of the display rack, the pressure acts on the slide portion of the lifting support, and the tension spring is stretched and is in a state of energy storage. When the articles on the bearing plate gradually decrease, the pressure on the slide portion decreases, and the tension spring is gradually retracted to be returned for driving the bearing plate to ascend, thereby realizing the lifting function of the display rack.

2. The tension spring arranged at the corner of the display rack is smaller in size, so its stiffness coefficient is less, and it is easier to be stretched and deformed. The display rack is suitable for displaying articles of light weight.

3. The slide portion provides a guide function for the lifting support to be moved up and down, so that the bearing plate can be moved up and down without shaking.

DETAILED DESCRIPTION OF THE PREFERRED EMBODIMENTS

Figure 1:
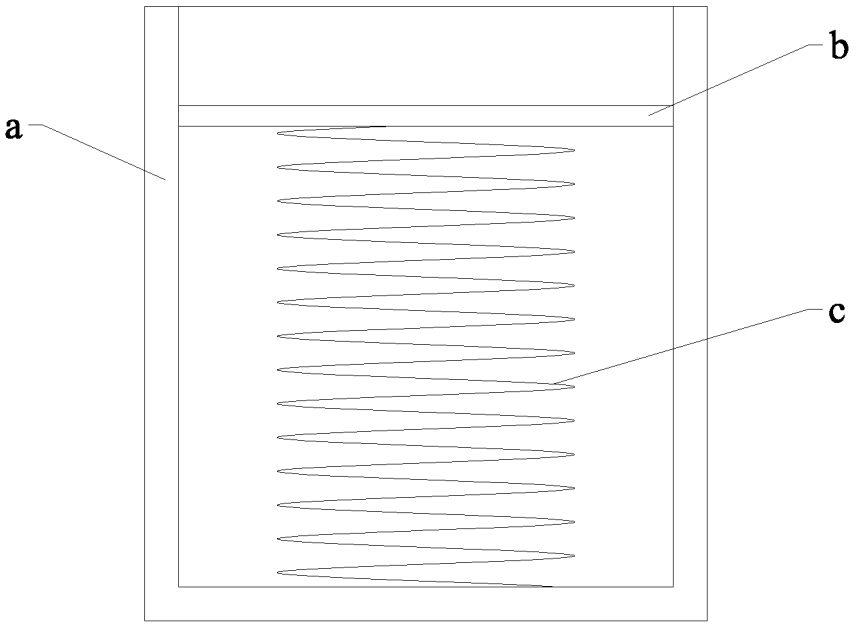
FIG. 1 (PRIOR ART)
FIG. 1 is a schematic view of a conventional display rack.
Figure 2:
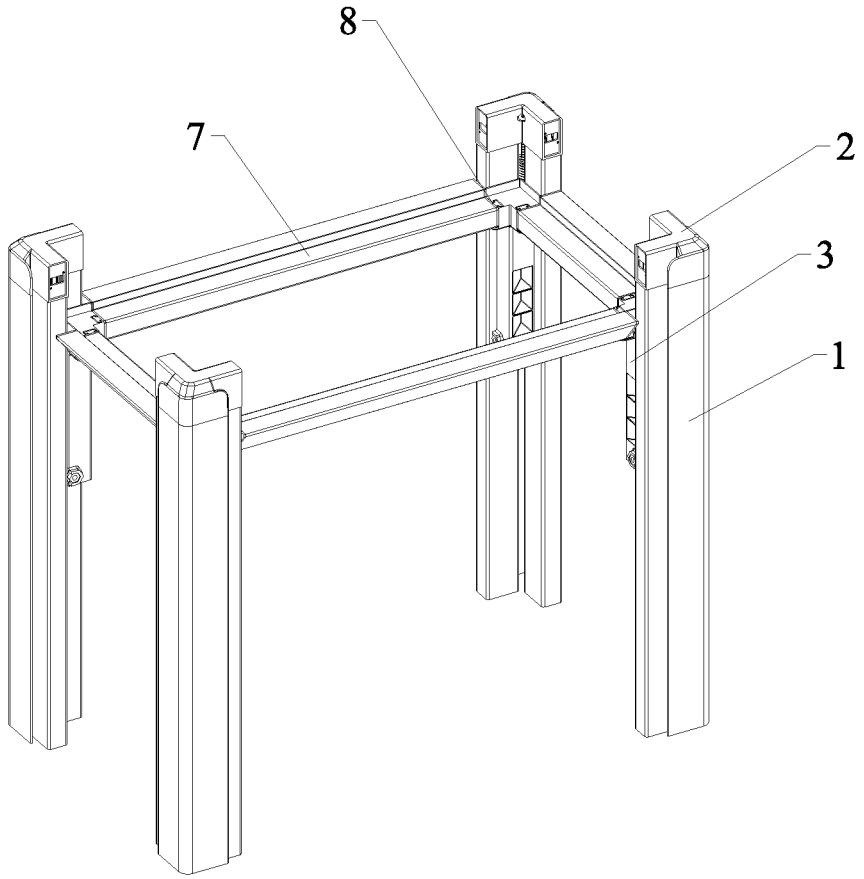
FIG. 2 is a perspective view of the lifting structure according to a preferred embodiment of the present invention.
Figure 3:
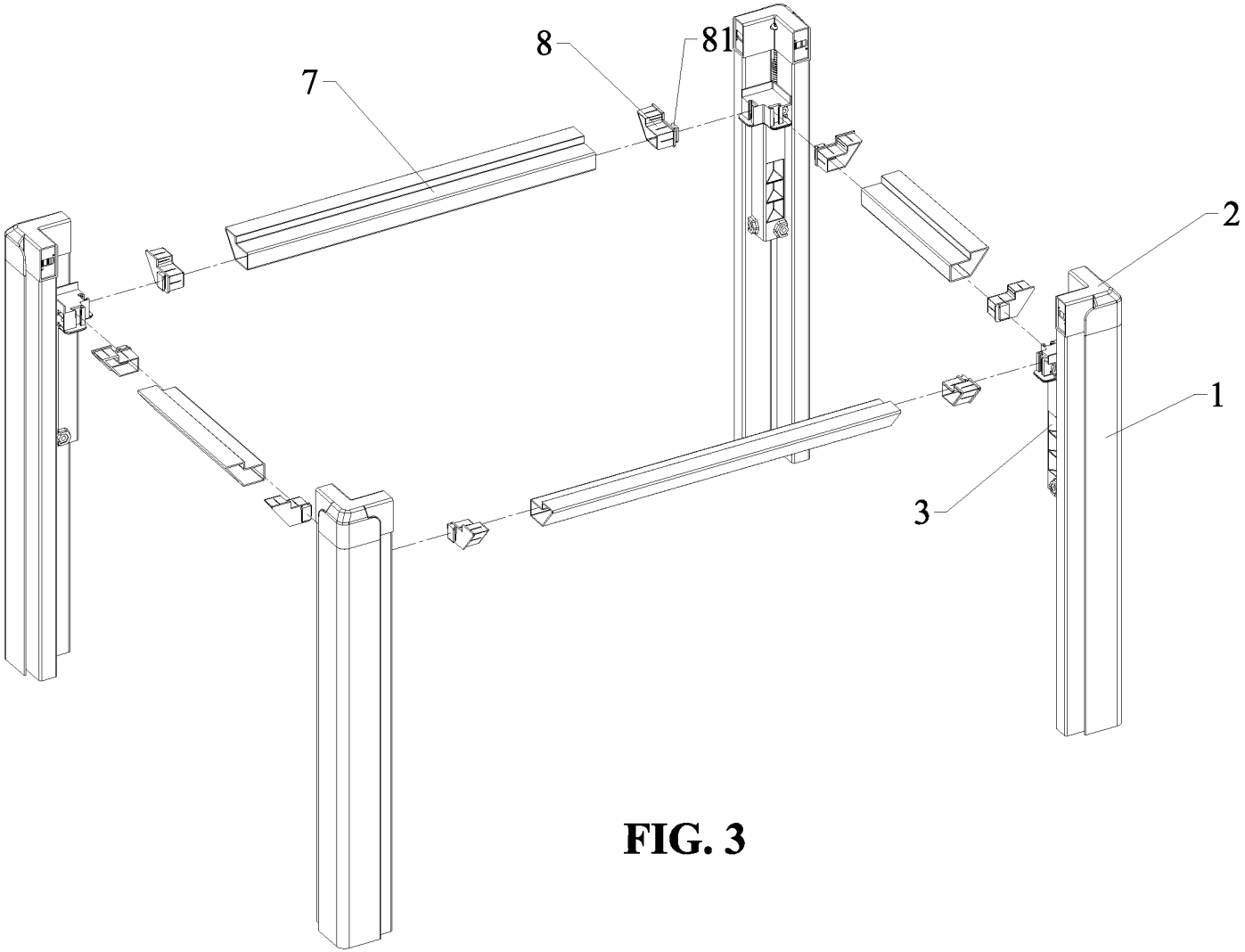
FIG. 3 is a first exploded view of the lifting structure according to the preferred embodiment of the present invention.
Figure 4:
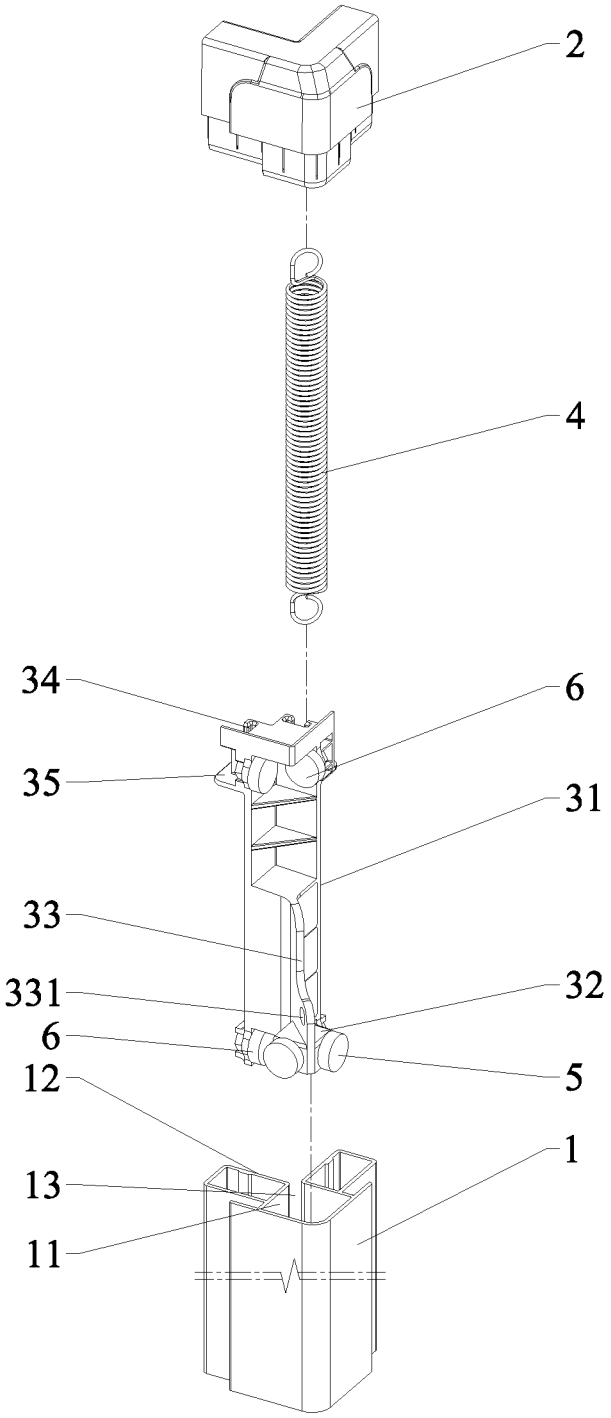
FIG. 4 is a second exploded view of the lifting structure according to the preferred embodiment of the present invention.
Figure 5:
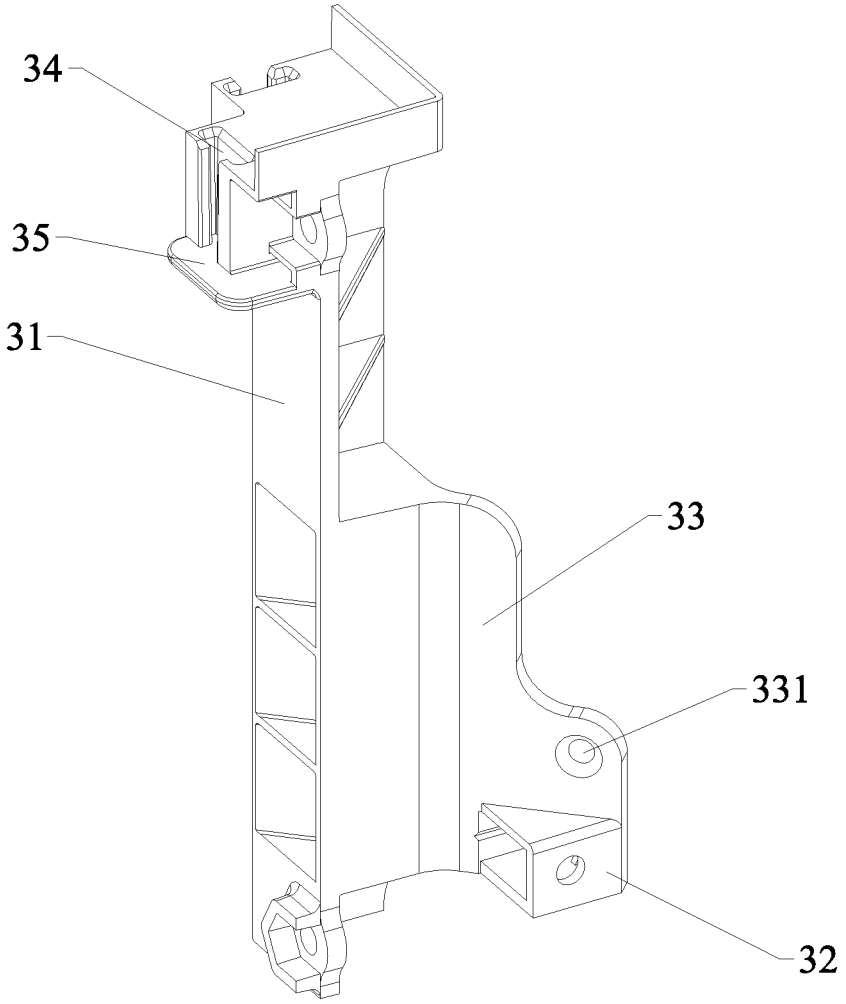
FIG. 5 is a perspective view of the lifting support according to the preferred embodiment of the present invention.
Figure 6:
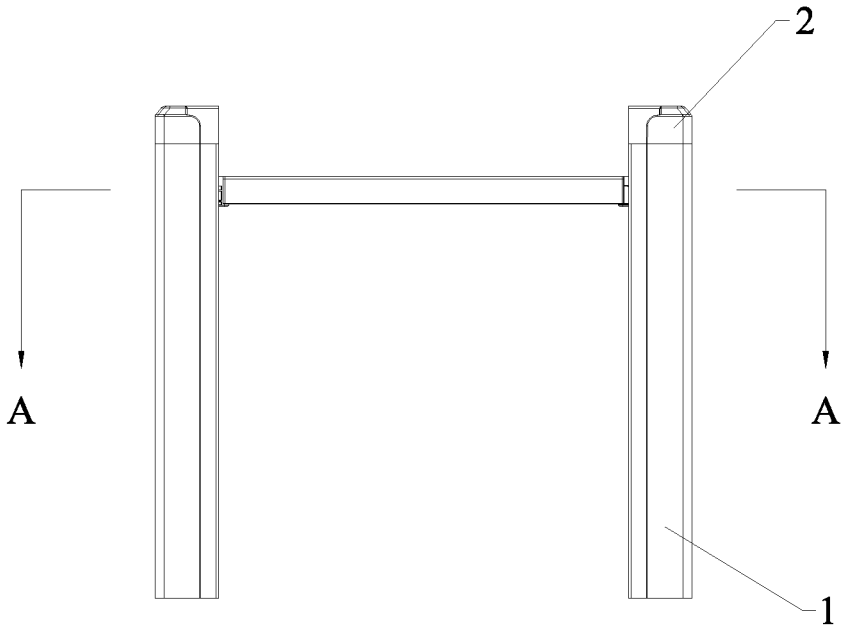
FIG. 6 is a front view of the lifting structure according to the preferred embodiment of the present invention.
Figure 7:
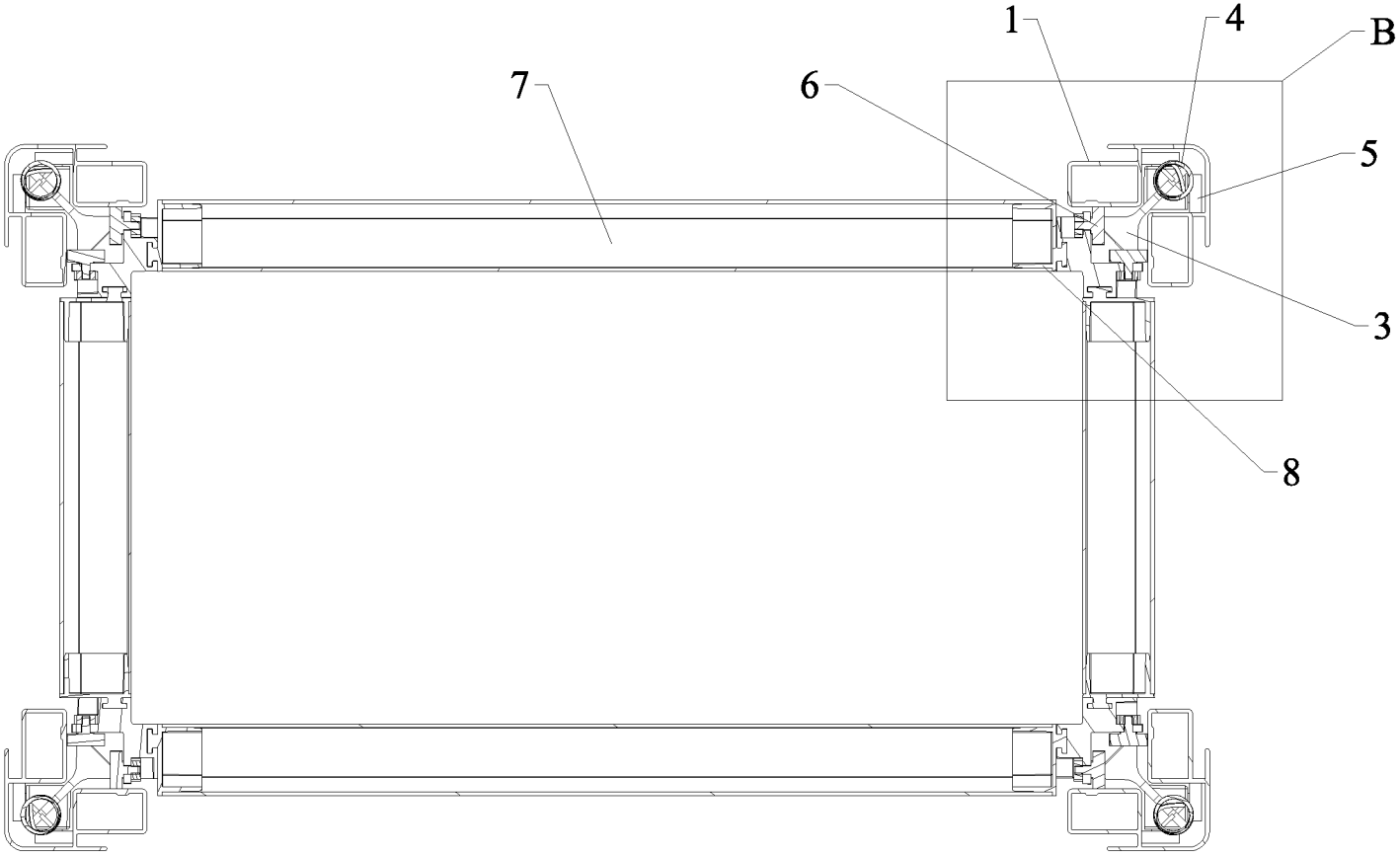
FIG. 7 is a cross-sectional view taken along line A-A of FIG. 6.
Figure 8:
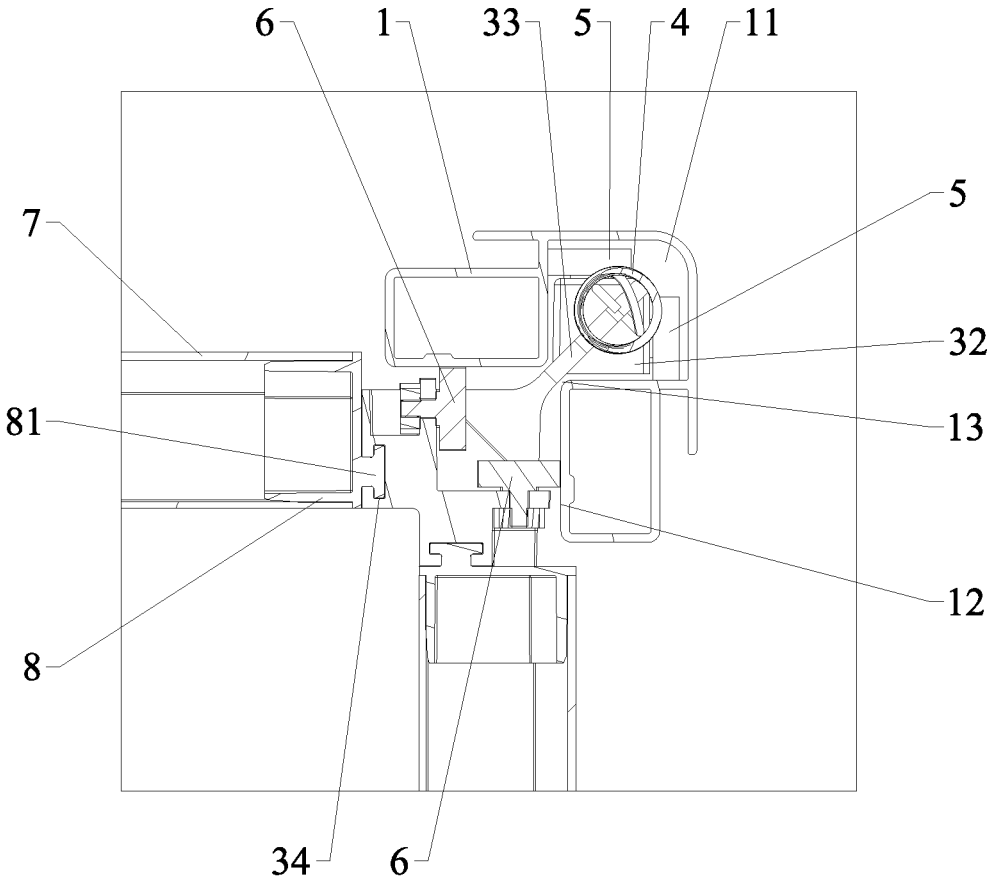
FIG. 8 is an enlarged view of rectangle B of FIG. 7.

Embodiments of the present invention will now be described, by way of example only, with reference to the accompanying drawings.

Referring to FIG. 2 through FIG. 9, the present invention discloses a lifting structure of a display rack, comprising an upright post 1, a retainer 2, a lifting support 3, and a tension spring 4.

The upright post 1 includes a guide rail 11 on the inner corner of the upright post 1.

The retainer 2 is installed on the upper end of the guide rail 11.

The lifting support 3 includes a support portion 31 that is movably fitted in the inner corner of the upright post 1 and a slide portion 32 that is slidably fitted in the guide rail 11. The support portion 31 is configured to support a bearing plate of the display rack.

The upper and lower ends of the tension spring 4 are connected to the retainer 2 and the slide portion 32, respectively.

Specific embodiments of the lifting structure are described below.

First rollers 5 are installed on the slide portion 32. The first rollers 5 are configured to roll on the side walls of the guide rail 11, which can reduce the friction between the slide portion 32 and the guide rail 11 in the process of moving the slide portion 32 up and down, so that the lifting support 3 can be moved up and down more smoothly.

Furthermore, the number of the first rollers 5 is two. The axes of the two first rollers 5 are perpendicular to each other, so that the two first rollers 5 are configured to roll on the adjacent side walls of the guide rail 11, thereby providing a guide function for the slide portion 32 to move up and down and reducing the shaking of the slide portion 32.

The inner corner of the upright post 1 includes two vertical faces 12 perpendicular to each other. The guide rail 11 is disposed at the joint between the vertical faces 12. A gap 13 is defined between the inner corner and the guide rail 11.

Furthermore, second rollers 6 are installed on the support portion 31. The second rollers 6 are configured to roll on the vertical faces 12, which can reduce the friction between the support portion 31 and the vertical faces 12 in the process of moving the support portion 31 up and down, so that the lifting support 3 can be moved up and down more smoothly.

Furthermore, the number of the second rollers 6 is two. The axes of the two second rollers 6 are perpendicular to each other, so that the two second rollers 6 are configured to roll on the vertical faces 12, thereby providing a guide function for the support portion 31 to move up and down and reducing the shaking of the support portion 31. When there are two first rollers 5 and two second rollers 6 on the lifting support 3, the shaking of the lifting support 3 to be moved up and down can be reduced greatly, so as to ensure smooth movement of the lifting support 3.

Furthermore, two pairs of upper and lower second rollers 6 are disposed on the support portion 31. When the support portion 31 is long, the shaking of the lifting support 3 to be moved up and down can be reduced by arranging two or more pairs of second rollers 6 whose axes are perpendicular to each other.

In addition, a connecting plate 33 is connected between the support portion 31 and the slide portion 32. The connecting plate 33 is in clearance fit with the gap 13, so that the connecting plate 33 can be moved up and down in the gap 13. In this embodiment, the connecting plate 33 has a mounting hole 331 for connection of the tension spring 4.

The retainer 2 is insertedly connected to the upper end of the upright post 1 to realize a detachable installation mode, and remains fixed on the upper end of the guide rail 11. The retainer 2 remains positioned on the upper end of the guide rail 11.

The lifting support 3 includes four lifting supports 3, so as to correspond to the four corners of the display rack. A support pipe 7 is connected between every adjacent two of the lifting supports 3, that is, four support pipes 7 are provided. The four lifting supports 3 and the four support pipes 7 are connected to form a frame structure for supporting the four corners and four sides of the bearing plate.

Further, a connector 8 is provided between the lifting support 3 and either end of the support pipe 7. One side of the lifting support 3 has a vertical engaging groove 34 and a restricting plate 35 under the engaging groove 34. One end of the connector 8 has an engaging block 81. The engaging block 81 is inserted downward and engaged in the engaging groove 34 to be positioned on the restricting plate 35. The support pipe 7 is sleeved on the other end of the connector 8. The connection strength between the support pipe 7 and the lifting support 3 can be improved via the connector 8 to be engaged with the lifting support 3 and via the support pipe 7 to be tight fit with the connector 8, thereby improving the stability of the overall structure.

Figure 9:
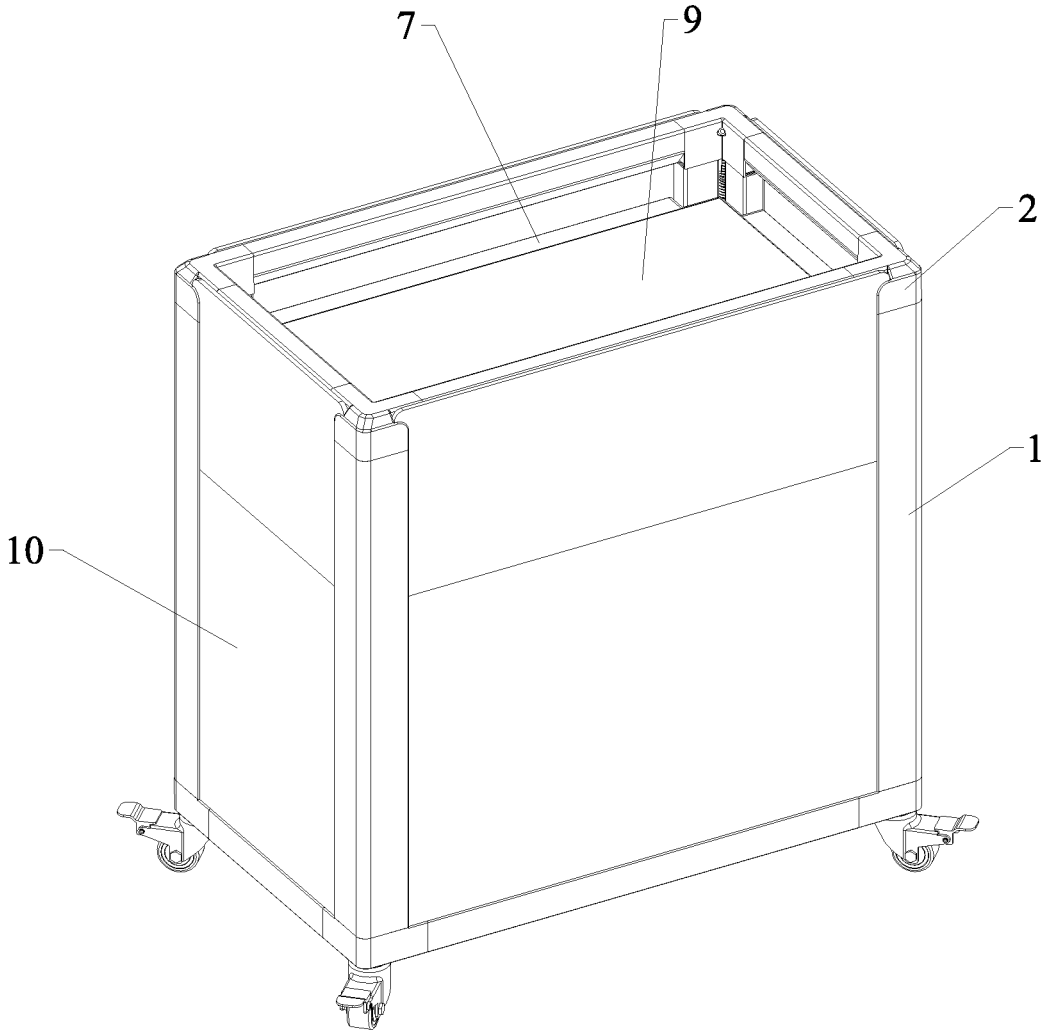
FIG. 9 is a perspective view of the display rack according to the preferred embodiment of the present invention.

Referring to FIG. 9, the present invention further discloses a display rack, comprising the lifting structure mentioned above. The four upright posts 1 of the display rack each have the lifting support 3.

Further, the display rack further comprises a bearing plate 9 installed on the support portion 31 and side plates 10 installed on the upright posts 1.

With the above solution, in the present invention, the guide rail 11 is disposed on the inner corner of the upright post 1, the slide portion 32 of the lifting support 3 is slidably connected to the guide rail 11, the retainer 2 is disposed on the upper end of the guide rail, and the upper and lower ends of the tension spring 4 are connected to the retainer 2 and the slide portion 32, respectively. When articles are placed on the bearing plate of the display rack, the pressure acts on the slide portion 32 of the lifting support 3, and the tension spring 4 is stretched and is in a state of energy storage. When the articles on the bearing plate gradually decrease, the pressure on the slide portion 32 decreases, and the tension spring 4 is gradually retracted to be returned for driving the bearing plate to ascend, thereby realizing the lifting function of the display rack. The tension spring 4 arranged at the corner of the display rack is smaller in size, so its stiffness coefficient is less, and it is easier to be stretched and deformed. The display rack is suitable for displaying articles of light weight. The slide portion 32 provides a guide function for the lifting support 3 to be moved up and down, so that the bearing plate can be moved up and down without shaking.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A lifting structure of a display rack, comprising an upright post, a retainer, a lifting support, and a tension spring, provided at each of four corners of the display rack;

the upright post including a guide rail on an inner corner of the upright post;

the retainer being installed on an upper end of the guide rail;

the lifting support including a support portion that is movably fitted in the inner corner of the upright post and a slide portion that is slidably fitted in the guide rail; the support portion being configured to support a bearing plate of the display rack;

upper and lower ends of the tension spring being connected to the retainer and the slide portion, respectively;

first rollers are installed on the slide portion, the first rollers are configured to roll on side walls of the guide rail; a number of the first rollers is two, and axes of the two first rollers are perpendicular to each other.

2. The lifting structure of the display rack as claimed in claim 1, wherein the inner corner of the upright post includes two vertical faces perpendicular to each other, the guide rail is disposed at a joint between the vertical faces, and a gap is defined between the inner corner and the guide rail.

3. The lifting structure of the display rack as claimed in claim 2, wherein second rollers are installed on the support portion, the second rollers are configured to roll on the vertical faces; a number of the second rollers is two, and axes of the two second rollers are perpendicular to each other.

4. The lifting structure of the display rack as claimed in claim 3, wherein the second rollers comprise a pair of upper second rollers and a pair of lower second rollers.

5. The lifting structure of the display rack as claimed in claim 2, wherein a connecting plate is connected between the support portion and the slide portion, the connecting plate is in clearance fit with the gap; the connecting plate has a mounting hole for connection of the tension spring.

6. The lifting structure of the display rack as claimed in claim 1, wherein the retainer is insertedly connected to an upper end of the upright post.

7. The lifting structure of the display rack as claimed in claim 1, wherein a support pipe is connected between every two lifting supports provided at two adjacent corners of the display rack respectively.

8. The lifting structure of the display rack as claimed in claim 7, wherein a connector is provided between each lifting support and a corresponding end of a corresponding support pipe; one side of each lifting support has a vertical engaging groove and a restricting plate under the engaging groove; one end of the connector has an engaging block, the engaging block is inserted downward and engaged in the engaging groove to be positioned on the restricting plate; the corresponding support pipe is sleeved on another end of the connector.

* * * * *